US007887360B2

(12) United States Patent
Andrade

(10) Patent No.: US 7,887,360 B2
(45) **Date of Patent: *Feb. 15, 2011**

(54) CORD, HOSE AND CABLE FASTENING SYSTEM AND METHOD

(76) Inventor: Kirk Andrade, 1921 Cooper Rd., Sebastopol, CA (US) 95472

( * ) Notice: Subject to any disclaimer, the term of this patent is extended or adjusted under 35 U.S.C. 154(b) by 0 days.

This patent is subject to a terminal disclaimer.

(21) Appl. No.: 12/433,511

(22) Filed: Apr. 30, 2009

(65) Prior Publication Data

US 2010/0279537 A1 Nov. 4, 2010

(51) Int. Cl.
*H01R 13/62* (2006.01)

(52) U.S. Cl. ..... 439/369; 439/371

(58) Field of Classification Search ..... 439/369, 439/371, 367

See application file for complete search history.

(56) References Cited

U.S. PATENT DOCUMENTS 2,406,567 A * 8/1946 Schueneman ..... 439/369
2,761,109 A * 8/1956 Hacker ..... 439/369
2,903,669 A * 9/1959 Gilman et al. ..... 439/369
3,499,103 A * 3/1970 Pearce ..... 174/135
4,440,465 A * 4/1984 Elliott et al. ..... 439/369
4,690,476 A * 9/1987 Morgenrath ..... 439/502
4,907,984 A 3/1990 Keller
5,044,976 A 9/1991 Thompson
5,139,429 A 8/1992 Herman
5,167,524 A * 12/1992 Falcon et al. ..... 439/371
5,328,384 A * 7/1994 Magnuson ..... 439/369
5,336,107 A * 8/1994 Sheryll ..... 439/369
5,348,495 A 9/1994 Kasden
5,547,390 A 8/1996 Laherty
5,713,753 A * 2/1998 Bayer et al. ..... 439/369
5,876,234 A * 3/1999 Hester ..... 439/369
5,913,693 A 6/1999 Fetterolf
6,217,366 B1 * 4/2001 Weisstock ..... 439/369
6,447,323 B1 * 9/2002 Watanabe ..... 439/371
6,997,734 B1 * 2/2006 McQuirter ..... 439/369

(Continued)

OTHER PUBLICATIONS

Kord-O-Lock Product Information (Dec. 2007).

(Continued)

*Primary Examiner*—Gary F. Paumen
(74) *Attorney, Agent, or Firm*—Loeb & Loeb LLP

(57) ABSTRACT

A system and method for providing cord, hose and cable fastening (CHCF) so Industrial, Commercial and Home users (ICAHUs) can assure that cords, hoses and cables, including but not limited to electrical cords, cannot be accidentally disconnected or unplugged. The system and method allows ICAHUs to work safely and efficiently and to avoid cords, hoses and cables that may accidentally disconnect or unplug themselves in the course of everyday use. ICAHUs can easily apply collar mechanisms to the end of cords, hoses or cables aft of said cord's respective plug ends, hose's ends or cables' ends, and then subsequently attach said collar mechanisms together using a series of collar ties that are adjustable in length and tension, and tie connectors which facilitate said adjustment of said collar ties. The method comprises a system in which cords, hoses and cables, including but not limited to standard electrical cords may be fastened together then held tightly together without easily becoming accidentally unplugged. Said system and method also supports securing said cord, hose or cable to itself, to another, or to an object to secure and store either before or after said cords, hoses and cables are used.

21 Claims, 9 Drawing Sheets

U.S. PATENT DOCUMENTS

| | | | | |
|---|---|---|---|---|
| 7,123,716 | B2 * | 10/2006 | Jozitis et al. | 379/438 |
| 7,303,418 | B2 * | 12/2007 | O'Connor | 439/277 |
| 7,407,405 | B1 * | 8/2008 | Slenczka | 439/369 |
| 7,442,067 | B1 * | 10/2008 | Amaral | 439/369 |
| 7,465,182 | B1 * | 12/2008 | McDonald | 439/369 |
| 2003/0139085 | A1 | 7/2003 | Lin | |
| 2003/0157824 | A1 | 8/2003 | Ito | |
| 2004/0097120 | A1 * | 5/2004 | Limber et al. | 439/369 |
| 2004/0166718 | A1 | 8/2004 | Yoest | |
| 2009/0064465 | A1 | 3/2009 | Andrade | |

OTHER PUBLICATIONS

Kord Manager Cord Lock Information (Mar. 2009).
Kord Manager Carry Strap Information (Mar. 2009).

* cited by examiner

CORD, HOSE AND CABLE FASTENING SYSTEM AND METHOD

This application is commonly-owned with U.S. patent application Ser. No. 11/279,993, now U.S. Pat. No. 7,811,117.

FIELD OF INVENTION

The present invention is in the field of Industrial, Commercial and Home use, specifically a system and method to safely fasten a cord, hose, or cable, including but not limited to an electrical cord, to another cord, hose or cable, to itself or other objects. Said cords, hoses or cables may include but shall not be limited to either a stand-alone electrical cord or an electrical cord attached to an electrical device such as a power tool or appliance. Said invention shall assure that said cords, hoses or cables remain connected in the course of normal use and do not become unplugged or disconnected from one another. The invention also serves to allow a user to attach said cord, hose or cable to itself of an object for purposes of organization, storage or transport.

BACKGROUND OF THE INVENTION

Today, it is necessary for Industrial, Commercial and Home users (ICAHUs) of tools and systems, including but not limited to electrical tools, electrical appliances and computer systems to work safely and efficiently. Often, cords, hoses or cables, including electrical cords, may accidentally unplug themselves or disconnect in the course of everyday use; thus, creating an inconvenience and possibly a safety hazard. To avoid said cords, hoses or cables from unplugging. ICAHUs often tape cords, hoses or cables together or take time to "wire them" or "rig them" together, tie them or just connect them together and hope they don't become accidentally disconnected. Cords, hoses and cables becoming disconnected can be hazardous, such as in the loss of power to a device, and scrambling around to connect cords, hoses or cables that become disconnected can be time consuming. For this reason and others, this present invention, a cord, hose and cable fastening (CHCF) system and method will easily accommodate and facilitate that said cords, hoses and cables used by ICAHUs stay connected during use.

ICAHUs need to work safely and efficiently. For example, an electrical device needs to remain plugged-in to be able to receive electricity to function. Time used to plug-in electrical devices that become unplugged is wasted. ICAHUs also may need to move within a work environment in which cords, hoses or cables may become snagged or caught on objects and could become disconnected. With the CHCF system and method, ICAHUs can easily fasten cords, hoses and cables together, including but not limited to, cords on electrical devices to assure they remain connected.

In addition, because of the need for ICAHUs to work safely and efficiently, companies such as Home Depot, Ace Hardware, Home Club, Sam's Club, K-Mart, Sears, Stanley, Loews, Wal-Mart and Costco, may more-than-likely desire to sell the cord, hose and cable fastening system and method that is comprised in this invention. This can be sold as a stand alone product or in combination with cords, hoses and cables, including but not limited to electrical cords and power devices, and cords attached to power tools.

Moreover, in addition to assuring that cords, hoses and cables remain connected during use, a need also exists for a system and method to help secure the cords, hoses and cables before and after use and to attach said cords, hoses and cables to objects or even to themselves. An example is the need for a typical construction worker who needs a system and method to attach lengthy and heavy extension cords or cables to his or her work truck at the end of the day and to have said cords and cables remain secure and in place. Another example is the need for a person to wrap a cord or cable after use and to securely fasten said cord or cable to a shelf or its resting place.

Heretofore, inventors have not created and developed a system and method for facilitating cord, hose and cable fastening that will fit easily on standard cords, hoses and cables, including but not limited to standard electrical cords, and that will actually hold them securely during the stresses and demands encountered in a work environment. This invention permits said ICAHUs to employ the CHCF system and method easily with many types of cords, hoses and cables, including standard, electrical cords that typically contain male and female connectors or plug ends that fasten by fitting the male connector into the female connector by using direct pressure without the need for any twisting of the connectors or their parts. This invention also allows ICAHUs to employ said CHCF system to secure said cords, hoses and cables by securing said cords, hoses and cables to another, to itself or to an object including but not limited to a work vehicle, and storage place or other object.

U.S. Patent Application Publication No. 2003/0157824 (Ito, August 2003), expressly incorporated herein by reference, relates to a method for a Power Cord Connecting Set which is similar to a cord fastening system and method. This existing art is for specific type of plug set, both male and female, and is not able to be easily fastened to existing standard electrical cords without replacing the actual plug ends of said electrical cords with specialized and customized plug ends. Moreover, the existing art will not allow itself to be easily removed from one set of electrical cords and then transferred to another without either heavy modification, and/or the possibility of ruining the existing set of plug ends. The existing art is specifically a type of complex plug end that is not simple in nature as opposed to this present invention which is not a plug end but instead a cord, hose and cable fastening system that will not require the modification or alteration of plug ends and that may be easily moved from cord, hose and cable sets to others.

U.S. Patent Application Publication No. 2003/0139085 (Chia Hsien, July 2003), expressly incorporated herein by reference, relates to a method for an Electric cord connector kit which is not similar to the cord, hose and cable fastening system and method of this present invention, in that the electrical cord connector kit is a kit used to "splice" together actual electrical cords and to join then together by crimping them, and is not designed to "connect" and "disconnect" or to hold standard cables, hoses and cords in place, for their easy and subsequent disconnecting after use. This existing art is for permanently joining together electrical cords and is quite different form this present invention in design and scope.

U.S. Pat. No. 5,044,976 (Thomson, 1991), expressly incorporated herein by reference, relates to an electrical cord holding device that possesses a hook-and-loop fastening mechanism that protrudes from, and is secured to, a cover plate, and a reciprocal second portion of a hook-and-loop fastening mechanism that is clamped onto a power cord, wherein the first and second portions of the hook-and-loop fastening mechanism assist in retaining a plug within an outlet. This existing art is specifically for connecting electrical cords into wall outlets and is entirely different in its scope and design from this present invention that is designed to securely maintain that cords, hoses and cables are connected together, with a focus on cables, hoses and cords that are standard, such as including but not limited to on electrical extension cords and electrical devices, such as is the engagement of a female plug head of an extension cord to the male plug head of a corded power tool or appliance.

U.S. Pat. No. 5,348,495 (Kasden, 1994), expressly incorporated herein by reference, relates to an "electrical cord plug lock assembly having a special electrical socket face plate with a pair of laterally spaced locking brackets extending outwardly from its front surface adjacent the opposite sides of the socket aperture." This existing art is specifically for connecting electrical cords into wall outlets and is entirely different in its scope and design from this present invention that is designed to securely maintain that cords, hoses and cables are connected together, with a focus on cables, hoses and cords that are standard such as including but not limited to on electrical extension cords and electrical devices, such as is the engagement of a female plug head of an extension cord to the male plug head of a corded power tool or appliance.

U.S. Pat. No. 5,547,390 (Laherty, 1996), expressly incorporated herein by reference, relates to an "electrical plug securing device provides a length of material and embodies appendages into which are formed slots". This existing art is specifically for connecting electrical cords into wall outlets and is entirely different in its scope and design from this present invention that is designed to securely maintain that cords, hoses and cables are connected together, with a focus on cables, hoses and cords that are standard such as including but not limited to on electrical extension cords and electrical devices, such as is the engagement of a female plug head of an extension cord to the male plug head of a corded power tool or appliance.

U.S. Patent Application Publication No. 2004/0166718, (Yoest, Daniel, August 2004), expressly incorporated herein by reference to a method for a power cord plug securing device is somewhat similar in purpose to the cord, hose and cable fastening system and method of this present invention, in that it is a system and method for securing power cords together; however, the existing art by Yoest claims the use of a "clasp member" that is "substantially U-shaped" in order to attach itself to an electrical cord, and in the present invention, a collar mechanism is used that is more secure. Also, in the existing art by Yoest, said "clasp member comprises a trough region with retaining walls extending therefrom, said retaining walls terminating in inwardly projecting ends for securely maintaining the portion of the power cord immediately aft of the plug head within said through region" which is markedly different from what is claimed in this present invention, in which a collar mechanism is used. Moreover, the existing art claims a device in which "at least one of said trough region and said retaining walls are at least partially textured or ribbed for increased frictional association with the portion of the power cord retained therein" which indicates that texture and ribbing are employed to create friction as a means of attaching a clasp to a power cord and retaining said power cord; however, in this present invention, what is claimed is the attachment of a collar mechanism to connect to a cord, hose or cable which is markedly different and uses pressure created by the use of fasteners and/or a snap-together hold to accomplish securing said collar mechanism to said cord, hose or cable, which is expected to secure more strongly to said cord, hose or cable than said existing art and therefore will out-perform said existing art. Moreover, existing art claims a "securing strap" which is formed out of one-piece that is also is joined by a "clasp member" on each respective end. Said "securing strap" is not adjustable and is a singular piece which posed two problems: 1) because said "securing strap" is not adjustable it may not fit on a myriad of power cords that employ different types and sizes of male or female plug ends; and 2) because said "securing strap" is a singular piece, it may be prone to failure in that it would be weakest in retaining connected cords when pressure was applied from the direct edge of the "securing strap" that was opposite from the cord, then when applied inward toward said cord. This present invention claims collar ties that are superior to "securing straps" because they are adjustable and therefore will fit a myriad of cords types and sizes. Moreover, this present invention claims the use of multiple collar ties so that they will be able to withstand the pressure that is applied to cords hoses and cables in a work environment, such as construction or carpentry, without having them become disconnected. Furthermore, this invention claims a collar mechanism that is markedly different from the existing arts claim of a "clasp member" that is "substantially U-shaped" employing a "trough region" in that said "clasp member" of existing art allows for said cord to be unseated and thereby removed from said "trough" of the "clasp member" when exposed to pressure, since it does not close around said cord and allows said cord to "pop-out"—thereby failing in its objective; whereby, said cord, hose or cable will not be allowed to become either unseated or removed from said collar mechanism of the present invention when exposed to pressure since said cord, hose or, cable is fully enclosed by said collar mechanism—thereby succeeding in its original purpose and objective.

An existing product is available called the "Kord-O-Loc" that uses two "L-shaped" pieces of plastic with serrated edges that lock together in an attempt to fasten electrical cords together; however said product rests on the back of the electrical cord plug ends, does not securely attach to the cords and is easily disconnected if the cords are pulled away from each other, particularly with a small amount of force in which the cords will "pop out" of said product.

An existing product is available called the "Kord Manager Cord Lock" that uses one "S-shaped" piece of plastic in an attempt to fasten electrical cords together; however said product rests on the back of the electrical cord plug ends, does not securely attach to the cords and is easily disconnected if the cords are pulled away from each other, particularly with a small amount of force in which the cords will "pop out" of said product. This product may damage or destroy said cords, and may fail in its objective if said cords are pulled away from each other with force.

Accordingly, existing inventions describe methods and systems for assuring that electrical cords remain plugged-in or connected, but there does not appear to be an invention that possesses all the features and components of our system and method for delivering a cord, hose and cable fastening solution as in this present invention. To summarize, the systems and methods of the existing inventions have one or more of these disadvantages:

- Existing art is not easy-to-use and requires modifying plug ends of electrical cords.
- Existing art requires replacing standard plug ends on cords with specialized or customized plug ends and therefore cannot be easily removed from one cord or device to another.
- Existing an employs the use of "clasps" to attach to a plug that rely on friction; but that ultimately will allow cords to "pop-in" and "pop-out" of said clasp as pressure is applied, thereby failing to secure said cord if it is dragged or pulled during working conditions and an obstacle or impediment snags said cord creating pressure on "clasps".

Existing art employs clasps that are "open" in that they do not surround the cord they attach to but allow the cord an area in which it may "pop-out" of said clasp when under pressure.

Existing art employs a singular securing strap that is not adjustable and therefore will not fit numerous types and sizes for male and female connectors and other connectors as are used on multiple cord configurations.

Existing art employs a singular securing strap that will not allow it to offset pressure paced upon cords when they are under stress during work conditions.

Existing art is not sufficiently strong enough to be used under work conditions, such as at a construction site, where tools are heavy, cords and cables are pulled tight, and fasteners that may fail can create a safety risk.

Existing art does not intelligently solve the problem of securing and fastening cords before and after the cord is used in a work setting.

SUMMARY OF THE INVENTION

The present invention relates to a system and method enabling a cord, hose or cable to remain connected to another cord, hose or cable and not to become accidentally disconnected or unplugged while being used by Industrial, Commercial and Home users (ICAHUs) that may be using cords, hoses or cables, including but not limited to cords on electrical tools and appliances. Said invention allows ICAHUs to work safely and efficiently. This present invention, a cord, hose and cable fastening (CHCF) system and method will easily accommodate and facilitate that said cords, hoses and cables used by ICAHUs stay connected during use.

This present invention will be described further in preferred embodiments, and it overcomes all of the above-mentioned disadvantages of today's existing art. This invention secures cords, hoses and cables together and provides an ideal solution for securely assuring that a cord, hose or cable remains connected to another cord, hose or cable, to itself or to another object. An example would be an extension cord or a device with a similar cord such as a power tool would remain connected to each other.

Broadly stated, this present invention is a cord, hose and cable fastening system and method that in its best mode form has multiple collar pieces, or members, that can fasten together to connect to a cord, hose or cable, multiple, or a plurality of, collar ties that are adjustable and tie connectors that can lock and unlock from each other in order to allow collar ties to adjust in order to create tension and thereby hold the cords, hoses or cables together.

The invention relates to a cord, hose and cable securing device, comprising a plurality of collar mechanisms for connecting to and retaining a cord, hose and cable therein; a plurality of collar ties that connect to the collar mechanisms; and a plurality of tie connectors for allowing collar ties to fasten together, thereby ensuring the connection between cords, hoses and cables. The invention also relates to a device wherein the collar mechanism further comprises a collar member, or piece, designed to connect to a cord, hose or cable by having a substantially identical collar member connect to it, thereby securing the cord, hose or cable, wherein the cord, hose or cable is fully enveloped and enclosed, wherein the cord, hose or cable is secured within the collar mechanism, and wherein the collar mechanism securely connects to the portion of the cord, hose or cable immediately aft of end of the cord, hose or cable or any plug head or fitting attached thereto.

The invention further relates to a method of maintaining a connection between cords, hoses and cables, comprising obtaining a device having a collar mechanism for connecting to the cords, hoses and cables, the collar mechanism having a collar tie in connection with the collar mechanism; and connecting the collar tie to a tie connector; the tie connector to facilitate, the adjustment of length and tension of the collar tie between the collar mechanism and the tie connector.

Other systems, methods, features, and advantages of the present invention will be or will become apparent to one with skill in the art upon examination of the following figures and detailed description. It is intended that all such additional systems, methods, features, and advantages be included within this description, be within the scope of the invention, and be protected by the accompanying claims.

BRIEF DESCRIPTION OF THE DRAWINGS

The accompanying drawings, which are incorporated in and constitute a part of this specification, illustrate an implementation of the present invention and, together with the description, serve to explain the advantages and principles of the invention. In the drawings.

DETAILED DESCRIPTION OF THE PREFERRED EMBODIMENTS

Figure 1:
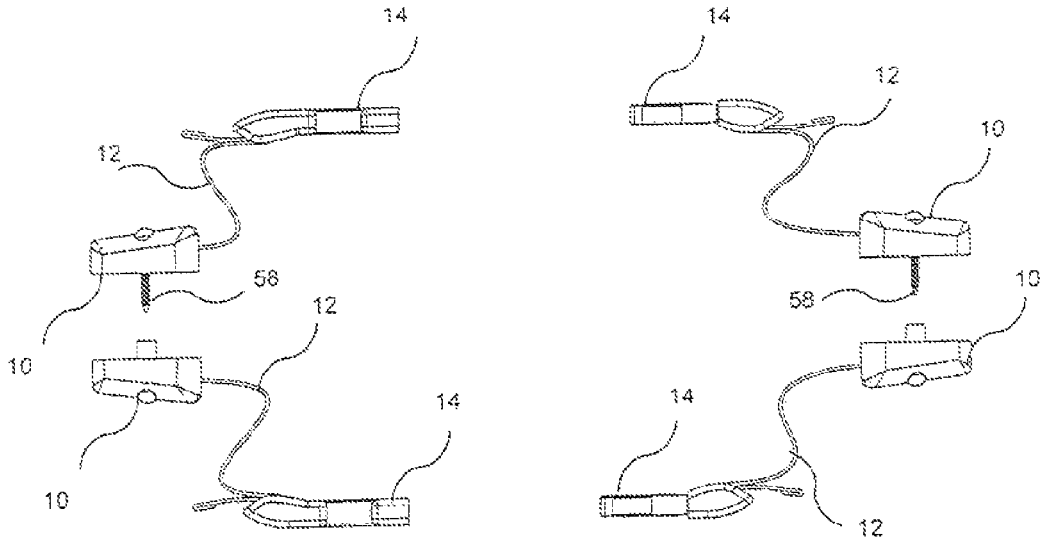
FIG. 1 is an illustration depicting the "Best Mode" Cord, Hose and Cable Fastening (CHCF) System and Method of the preferred embodiment in which a multiple-piece, or member, collar mechanism is employed.

In greater detail, this present invention, in its preferred form, is a cord, hose and cable securing, device having collar pieces, or members, that fasten together to connect to a cord, hose or cable and that may be fastened together by means, including but not limited to, screws, screwing through holes in one collar and screwing into another; bolts, protruding through one collar and screwing into either the opposite collar or into a nut embedded in the opposite collar; a snap hold, in which two collar pieces, or members, are adjoined on one edge and in which the opposite edge is able to close down and thereby crimp the cord, holding it, and in which a protrusion on one edge of the collar opposite the adjoined edge is snapped over the adjoined collar onto its edge opposite the adjoined edge. The present invention may also employ collar mechanisms that snap or lock together that may not be adjoined, but may be separate pieces, or members. The collar mechanisms of this present invention are designed to fully enclose around the cord, hose or cable and therefore shall not allow for an area in which the cord, hose or cable may "pop-out" or escape the collar as is the case with existing art.

Moreover, collar ties are connected to collar pieces, or members, and may be connected by means, including but not limited to, placing a rivet, grommet or similar member in said collar tie and then sliding said collar tie into a tapered groove in said collar until said rivet, grommet or similar member seats itself in said tapered groove, thereby becoming fastened. Collar ties may be connected to collar pieces, or members, by means, including but not limited to, weaving said collar tie through spaces in said collar in which the use of tension may will cause said collar tie to hold the collar firmly enough to allow the present invention to function.

Moreover, the use of glues, epoxies or other fastening adhesives may be applied in order to secure said collar tie to said collar or also itself. Said collar ties may be made out of numerous types of material including but not limited to woven fabric, nylon, polypropylene, mesh-type material, or other similar material. Said collar ties connect to tie connectors that may use numerous configurations including but not limited to male and female buckles, any type of dual-adjust buckle or fastener, snap-together assemblies or other means. The collar pieces, collar ties and tie connectors may comprise a plurality of individual members or be a single molded member. Further, the collar pieces and collar ties may also comprise a plurality of members or a single molded member.

The purpose of the tie connectors are to allow said collar ties to be adjusted and to then hold to each opposite tie connector, in order to allow adjustable tension to be created and thereby held in order to transfer and thereby keep tension on the ends of cords, hoses and cables that should remain connected to expedite a process, such as the uninterrupted flow of electricity in the case of an electrical cord.

Accordingly, a feature and advantage of this present invention is its ability to prevent accidental or forced disconnection of cords, hoses and cables, such as electrical cords. In other terms, this present invention assures that cords, hoses and cables remain connected.

Another feature and advantage of this present invention is its ability to allow the cord, hose or cable to be attached to another, or itself or an object in order to store and secure said cord, hose or cable. This is done by allowing said collar ties to be adjustable in length and by allowing said tie connectors to fasten to each other. For example, if a cord, hose or cable has the present invention secured to it, said tie connectors may be wrapped around a metal bar on the back of a work vehicle and subsequently connected to one another, then said collar ties may be used in order to create tension in the collar ties and thereby secure said cord, hose or cable to said work vehicle or other similar object.

This invention can be used to help secure the cords, hoses and cables before and after use and to attach said cords, hoses and cables to objects or even to themselves. An example is the need for a typical construction worker who needs a system and method to attach lengthy and heavy extension cords, hoses or cables to his or her work truck at the end of the day and to have said cords, hoses and cables remain secure and in place. Another example is the need for a person to wrap a cord, hose or cable after use and to securely fasten said cord, hose or cable to a shelf or its resting place. Furthermore, the present invention can be used to secure, not only cords and cables, but hoses and other objects that can be stored in a coiled form.

Another feature and advantage of the present invention relates to the ease of manufacture of the cord, hose and cable fastening device. Because of the design of the device, the production of the device is very simple and inexpensive. Once the collar pieces are manufactured, they are easily coordinated with the collar ties to produce the cord, hose and cable fastening device of the invention. Competing devices, even if relatively easy and low-cost to manufacture, still have the disadvantages in performance (e.g., failure during normal use).

The preferred embodiment of the present invention will now be described in even greater detail by reference to the following figures.

FIG. 1 depicts the overall "Best Mode" Cord and Cable Fastening (CCF) system and method of the preferred embodiment which includes a series of collar pieces 10 that can be fastened together using a myriad of methods including but not limited to being screwed together using standard screws. Said collar pieces 10 may also be snapped together or attached together by connection means 58, as their function is still to connect to a cord or cable in order to hold the cord or cable and to create a place to connect to a collar tie 12, which fits between said collar 10 and also fastens to an tie connector 14 that may be designed in a fashion, including but not limited to a male into female plastic-type buckle, a snap connector, or other means. Here, the connection means 58 is depicted as a screw. In any case, said tie connectors 14 are designed to connect to each other and said collar tie 12 is designed to be adjustable to remove slack between said collar piece 10 and said tie connector 14, which thereby is able to create pressure that will aid in assuring that cords, hoses and cables can remain connected to each other.

Figure 2:
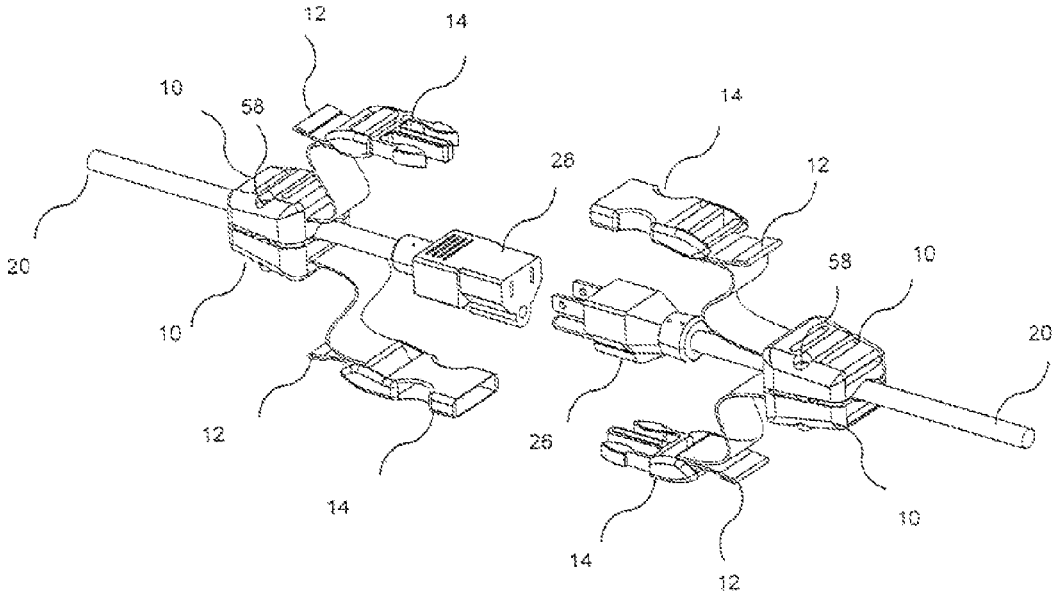
FIG. 2 is an illustration depicting a mode of the Cord, Hose and Cable Fastening (CHCF) System and Method, including Cord, of the preferred embodiment.

FIG. 2 depicts the overall Cord. Hose and Cable Fastening (CHCF) system and method, including a cord, of the preferred embodiment which is similar to FIG. 1 and also includes a series of collar pieces 10, collar ties 12, and tie connectors 14. Said collar pieces 10, said collar ties 12, and said tie connectors 14 are arranged so that an electrical cord 20 can be fastened to another in a familiar way in which an electrical cord male plug 26 can be inserted into an electrical cord female plug 28, and whereby said collar pieces 10 may fasten to said electrical cord 20, and in which said tie connectors 14 may attach to one another to then allow for adjustable collar ties 12 to be adjusted so slack in said collar ties 12 is reduced and so pressure is created to hold said electrical cord male plug 26 together with said electrical cord female plug 28, thereby not allow them to become unplugged and/or disconnected through normal use. Here, the collar pieces 10 are held together using connections 58, which are depicted as screws, but may also be a snap hold connection or a nut and bolt pair.

Figure 3:
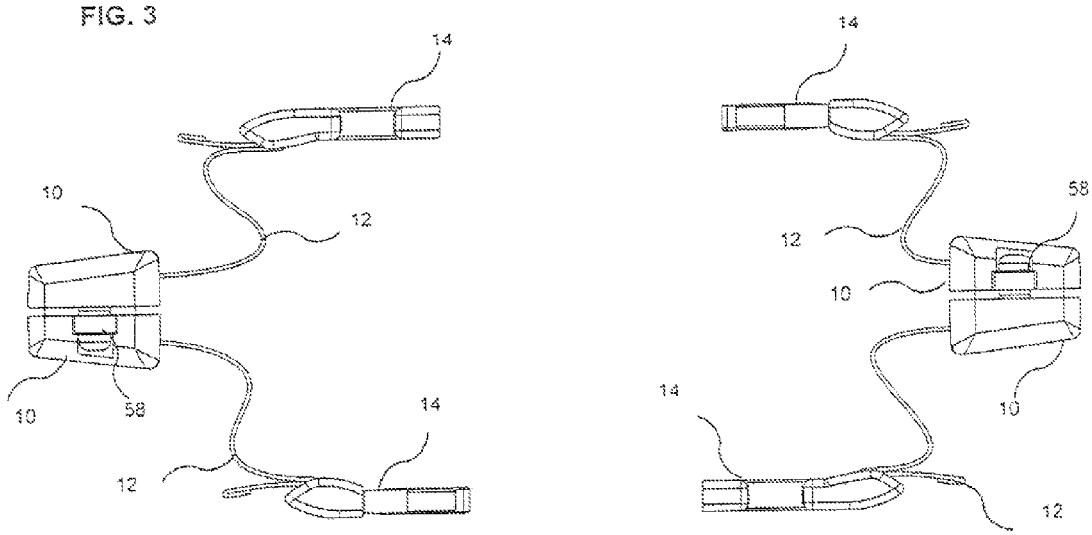
FIG. 3 is an illustration depicting the Cord, Cable and Cable Fastening (CHCF) System and Method, with a snap hold collar mechanism, of the preferred embodiment.

FIG. 3 depicts the Cord, Hose and Cable Fastening (CHCF) system and method with a snap hold of the preferred embodiment which includes a series of collar pieces 10 that can be fastened together using a myriad of methods including but not limited to being screwed together using standard screws. Said collar pieces 10 may also be snapped together using connections 58. Here, the connections 58 are snap holds that are molded into said collar pieces 10 in which one collar is adjoined to another on one edge and design to fold over in order to connect to said cord, hose or cable, and whereby one edge opposite of the adjoined edge of said collar 10 is designed with a protrusion that will slide over an indentation in the one edge opposite of the adjoined edge of said adjoined collar 10 thereby forming a snap hold 58, thus allowing them to fasten to said cord, hose or cable. Collar pieces 10 may also be attached together by a connection means, as their function is still to connect to a cord, hose or cable in order to hold the cord, hose or cable and to create a place to connect to a collar tie 12, which fits between said collar 10 and also fastens to an tie connector 14 that may be designed in a fashion, including but not limited to a male into female plastic-type buckle, a snap connector, or other means. In any case, said tie connectors 14 are designed to connect to each other and said collar tie 12 is designed to be adjustable to remove slack between said collar 10 and said tie connector 14, which thereby is able to create pressure that will aid in assuring that cords, hoses and cables remain connected to each other in the course of use.

Figure 4:
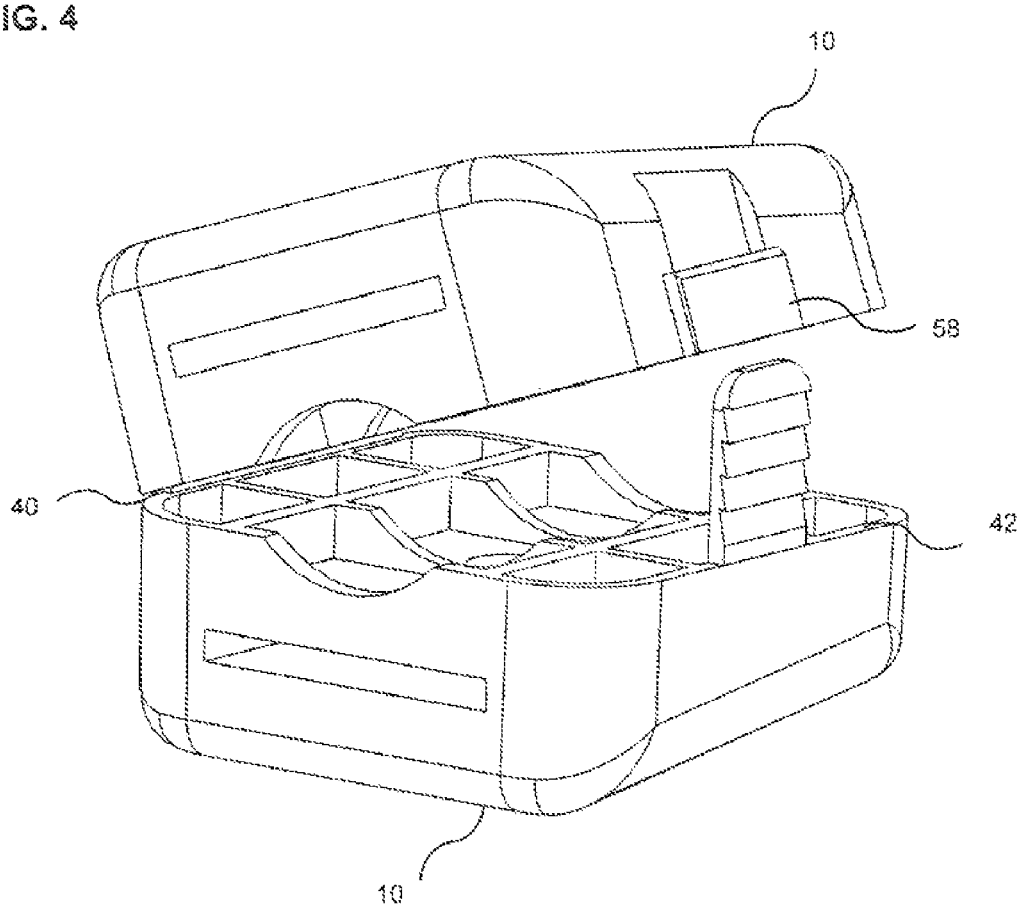
FIG. 4 is an illustration depicting a perspective View of a Collar Mechanism, with a snap hold, of the preferred embodiment.

FIG. 4 depicts a perspective View of a Collar Mechanism, with a snap hold, of the preferred embodiment, which displays a series of collar pieces 10 that can be fastened together using connections 58. Here, the connections 58 are snap hold connections, which can be fastened and unfastened by snapping them and unsnapping them by the use of the snap hold 58 that is molded into said collar pieces 10 in which one collar is adjoined to another on one edge, the adjoined edge 40, whereby a design is formed to allow said collar pieces 10 to fold open, remaining adjoined at the adjoined edge 40, and whereby the edge opposite the adjoined edge 42 comes apart creating and area in which a cord, hose or cable may be inserted, before said collar pieces 10 are moved toward each other and any distance between the collar pieces 10 at said edge opposite adjoined edge 42 decreases and then said snap hold is employed in order to connect said collar mechanism to said cord, hose or cable, thereby connecting to it securely, allow no area in which said cord, hose or cable can "pop-out" or escape said collar mechanism.

Figure 5:
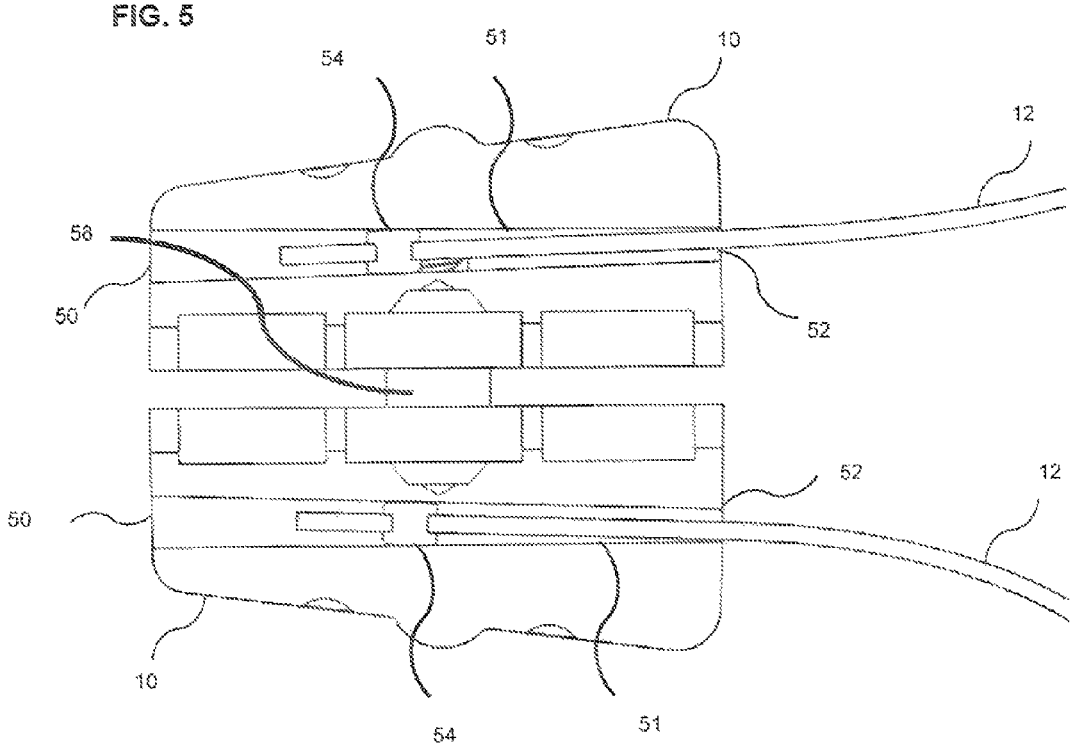
FIG. 5 is an illustration depicting a cross section of a collar mechanism of the Invention.

FIG. 5 is an illustration of a cross section of one collar mechanism comprising two collars 10, which can be attached by a fastening mechanism 58. The fastening mechanism can be, but is not limited to, a screw, a nut and bolt pair, or a snap-hold connection. Each collar piece 10 has a tapered groove 51 having a large-sized end 50 and a small-sized end 52. A collar tie 12 is threaded through the large-sized end 50 and out the small-sized end 52 of the tapered groove 51. The collar tie is held firmly in place by using a rivet 54 that will not fit through the small-sized end 52 of the tapered groove 51. When the collar ties 12 are fastened to a second collar tie 12 and adjusted, the collar mechanisms crimp down on the cord, hose or cable, holding it in place so that it will not slide or move. Thus any end of a cord, hose or cable is held safely and firmly attached to an end of a second cord, hose or cable.

Figure 6:
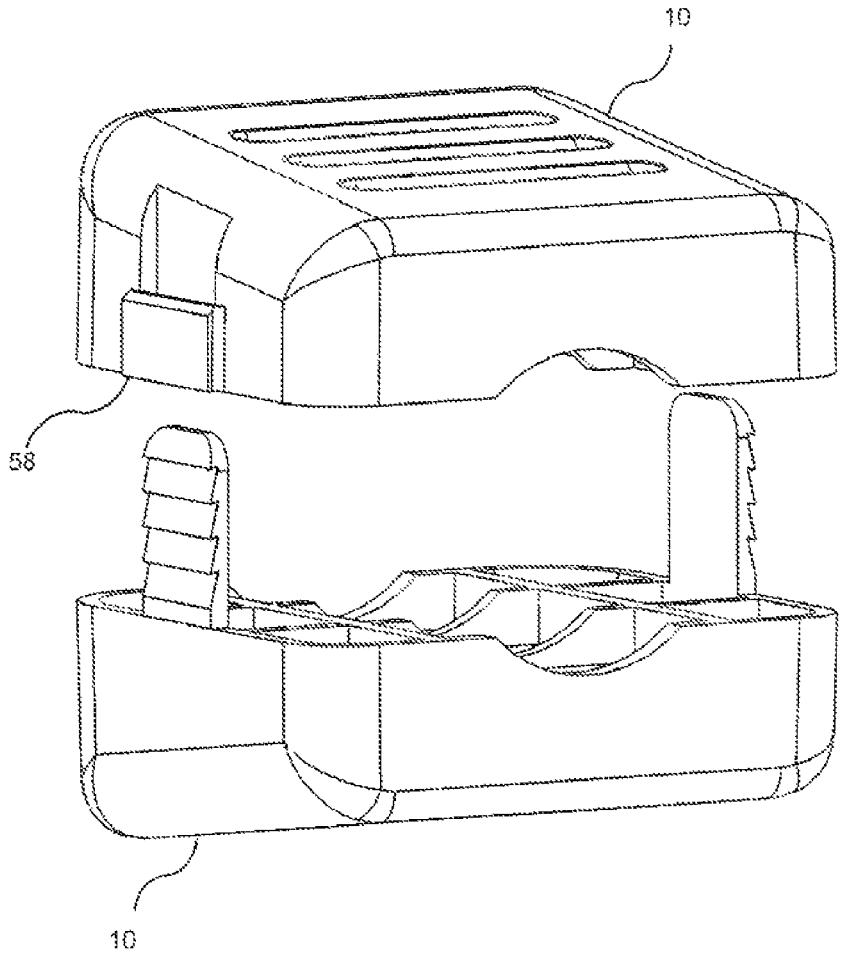
FIG. 6 is an illustration depicting a rear view of a collar mechanism of the invention having a snap hold connection.

FIG. 6 is an illustration of a rear view of a collar mechanism having a snap'hold connection. The collar mechanism includes collar pieces 10 that can be fastened together using connections 58. Here, the connections 58 are snap hold connections, which can be fastened and unfastened by snapping and unsnapping. The snap hold connections are molded into said collar pieces 10. The collar pieces 10 come apart creating an area in which a cord, hose or cable may be inserted. The collar pieces 10 close around the cord, hose or cable and fastened using the snap hold connection. The collar mechanisms are securely connected to the cord, hose or cable, so that the cord, hose or cable will not "pop-out" or escape said collar mechanism.

Figure 7:
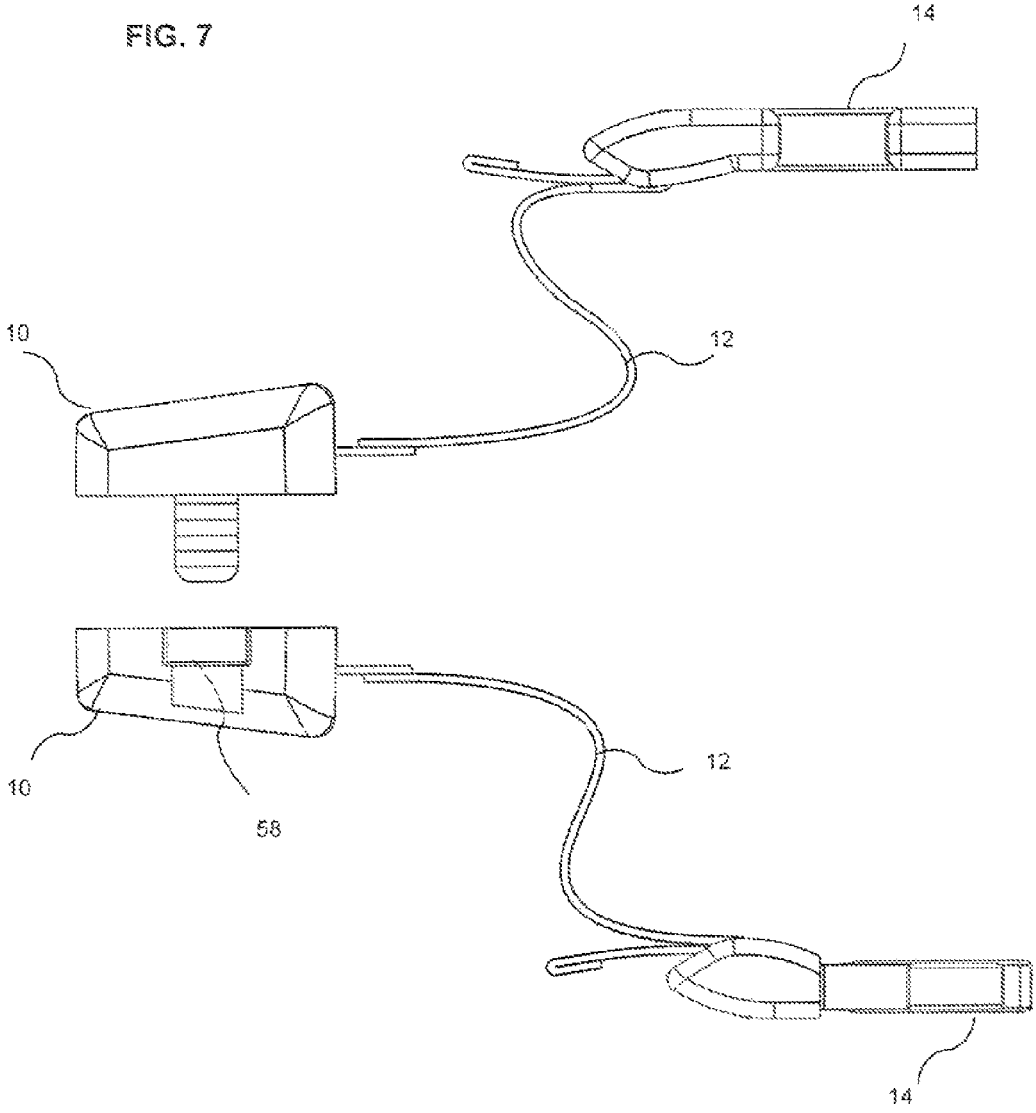
FIG. 7 is an illustration depicting a CHCF system of the invention having the collar ties attached to the collar pieces using an adhesive.

FIG. 7 is an illustration of a CHCF system of the invention, wherein the collar pieces 10 are fastened together using a snap hold connection. Alternatively, the collar pieces 10 can be screwed together using standard screws. The collar pieces 10 are shown here as attached to the collar ties 12. This attachment to the collar ties 12 may be by various connections means, including, but not limited to, glues, epoxies, fastening adhesives. Alternatively the collar pieces 10 and collar ties 12 can be combined as a single molded unit.

Figure 8:
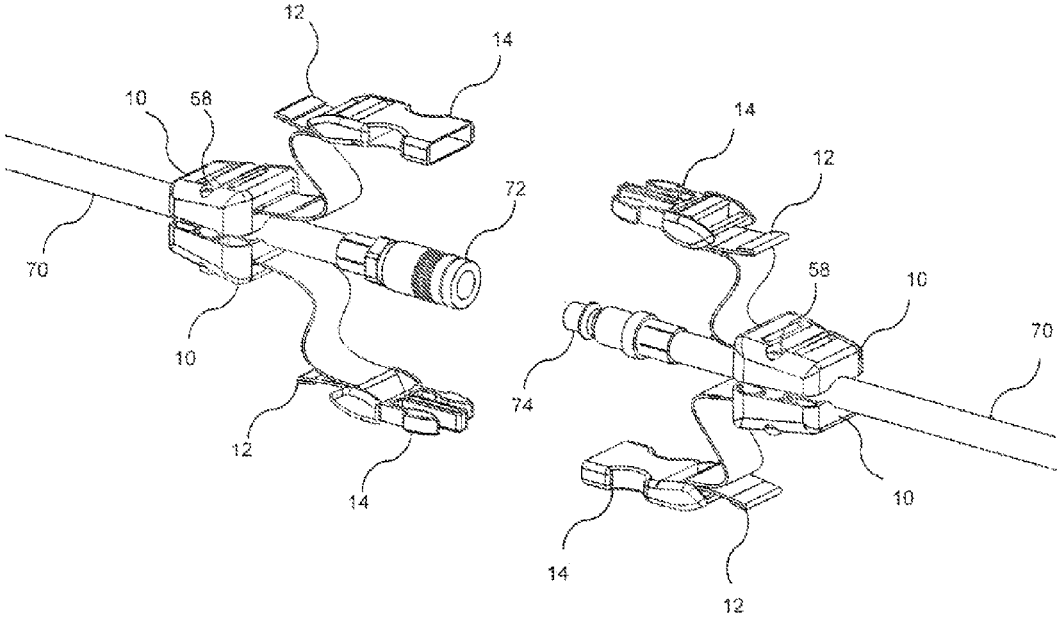
FIG. 8 is an illustration depicting a cord, hose and cable fastening (CHCF) system of the invention in use on a hose.

FIG. 8 is an illustration of the cord, hose and cable fastening (CHCF) system in use on a hose. The CHCF includes a plurality of collar pieces 10, collar ties 12, and tie connectors 14. The collar pieces 10, collar ties 12, and tie connectors 14 are arranged so that a hose 70 can be fastened to itself or another hose. For example, a hose male plug 74 can be inserted into a hose female plug 72. The collar pieces 10 may crimp around the hose 70, the tie connectors 14 may attach to one another, which allows adjustment of the collar ties 12, reducing the slack in said collar ties 12 and securely holding the hose male plug 74 together with said hose female plug 72. The collar pieces 10 are held together by connections 58, which are depicted as screws, but may also be a snap hold connection or a nut and bolt pair.

Figure 9:
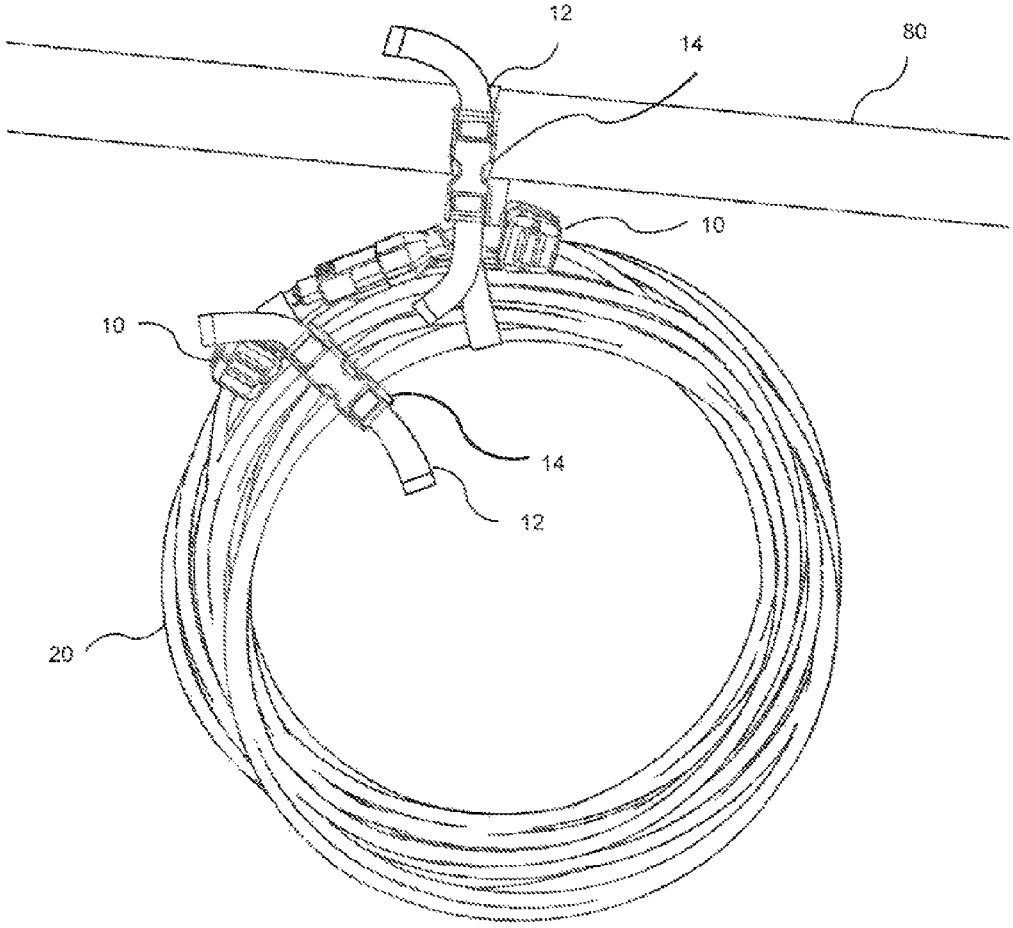
FIG. 9 is an illustration of the cord, hose and cable fastening system in use in an organization, storage and transport mode of the invention.

FIG. 9 is an illustration of the cord, hose and cable fastening system in use in an organization, storage and transport mode of the invention. Two ends of an electrical cord 20 are secured to each other. Here, the collar pieces 10 are secured to two ends of an electrical cord 20 through the use of collar ties 12 and tie connectors 14, in which one set of said collar ties 12, tie connectors 14 and collar pieces 10 are secured to one end of the electrical cord 20 and the second set of collar ties 12, tie connectors 14 and collar pieces 10 are secured to the other end of the electrical cord 20. If desired, the device can hang from a bar 80, such as, but not limited to, part of a vehicle.

The foregoing description and drawings merely explain and illustrate the invention and the invention is not limited thereto. While the specification in this invention is described in relation to certain implementation or embodiments, many details are set forth for the purpose of illustration. Thus, the foregoing merely illustrates the principles of the invention. For example, the invention may have other specific forms without departing from its spirit or essential characteristic. The described arrangements are illustrative and not restrictive. To those skilled in the art, the invention is susceptible to additional implementations or embodiments and certain of these details described in this application may be varied considerably without departing from the basic principles of the invention. It will thus be appreciated that those skilled in the art will be able to devise various arrangements, which, although not explicitly described or shown herein, embody the principles of the invention and, thus, are within its scope and spirit.

What is claimed is:

1. A securing system, comprising:

a first cord, hose or cable having a first plug;

a second cord, hose or cable having a second plug;

a first collar mechanism configured to crimp around the first cord, hose or cable adjacent to the first plug;

a second collar mechanism configured to crimp around the second cord, hose or cable adjacent to the second plug;

a securing means for securing the first plug to the second plug, the securing means comprising:

a first collar tie connected to the first collar mechanism;

a first tie connector attached to the first collar tie;

a second collar tie connected to the second collar mechanism; and a second tie connector attached to the second collar tie, wherein the first tie connector is configured to be fastened to the second tie connector; and a connector means for connecting the first collar tie to the first collar mechanism, the connector means selected from the group consisting of an adhesive, a distended portion wedged within a tapered groove in first collar mechanism, and a single molded unit comprising the first collar tie with the first collar mechanism.

2. The system of claim 1, wherein the collar ties are made from a mesh-type material.

3. The system of claim 1, wherein the distended portion comprises a rivet or grommet.

4. The system of claim 1, wherein the first collar mechanism comprises a first collar piece and a second collar piece wherein each of the first collar piece and the second collar piece includes a concave region to align with the first cord, hose or cable when the first collar mechanism is crimped around the end of the first cord, hose or cable.

5. The system of claim 4, further comprising a fastener to fasten the first collar piece and the second collar piece.

6. The system of claim 5, wherein the fastener comprises a screw, a nut and a bolt, or a snap-hold connection.

7. The system of claim 1, wherein the first collar mechanism comprises:

a first collar piece having a first edge and a second edge opposite the first edge;

a second collar piece having a first edge and a second edge opposite the first edge wherein the first edge of the first collar piece is adjoined to the second edge of the second collar piece;

a first snap hold portion connected to the first collar piece along the second edge; and a second snap hold portion connected to the second collar piece along the second edge wherein the first snap hold portion is configured to lock with the second snap hold portion to crimp the first collar mechanism onto the end of the first cord, hose or cable.

8. The system of claim 1, wherein the collar ties are adjustable in length and tension.

9. The system of claim 1, wherein the first and second cords, hoses or cables are selected from the group consisting of an indoor plug wire, an outdoor plug wire, a telephone plug wire, a LAN plug wire, a WAN plug wire, a cable wire, a data cable, a hose for liquid or gas, and a coaxial cable; and wherein the first and second plugs are selected from the group consisting of an industrial plug and an appliance plug.

10. The system of claim 1, wherein the first collar mechanism comprises:

a first collar piece having a first edge and a second edge opposite the first edge;

a second collar piece having a first edge and a second edge opposite the first edge wherein the first edge and second edge of the first collar piece is not adjoined to the first and second edge of the second collar piece;

a first snap hold portion connected to the first collar piece along the second edge; and a second snap hold portion connected to the second collar piece along the second edge wherein the first snap hold portion is designed to lock with the second snap hold portion to crimp the first collar mechanism onto the end of the first cord, hose or cable.

11. The device of claim 10, wherein the first collar mechanism comprises:

a first collar piece having a first edge and a second edge opposite the first edge;

a second collar piece having a first edge and a second edge opposite the first edge wherein the first edge and second edge of the first collar piece is not adjoined to the first and second edge of the second collar piece;

a first snap hold portion connected to the first collar piece along the second edge; and a second snap hold portion connected to the second collar piece along the second edge wherein the first snap hold portion is designed to lock with the second snap hold portion to crimp the first collar mechanism onto the end of the first cord, hose or cable.

12. A securing device, comprising:

a first collar mechanism configured to crimp around an end of a first cord, hose or cable;

a second collar mechanism configured to crimp around an end of a second cord, hose or cable;

a securing means for securing the first cord, hose or cable to the second cord, hose or cable, the securing means comprising:

a first collar tie connected to the first collar mechanism;

a first tie connector attached to the first collar tie;

a second collar tie connected to the second collar mechanism; and a second tie connector attached to the second collar tie, wherein the first tie connector is configured to be fastened to the second tie connector; and a connector means for connecting the first collar tie to the first collar mechanism, the connector means selected from the group consisting of an adhesive, a distended portion wedged within a tapered groove in first collar mechanism, and a single molded unit comprising the first collar tie with the first collar mechanism.

13. The device of claim 12, wherein the collar ties are made from a mesh-type material.

14. The device of claim 12, wherein the distended portion comprises a rivet, grommet.

15. The device of claim 12, wherein the first collar mechanism comprises a first collar piece and a second collar piece wherein each of the first collar piece and the second collar piece includes a concave region to align with the first cord when the first collar mechanism is crimped around the end of the first cord, hose or cable.

16. The device of claim 15, further comprising a fastener to fasten the first collar piece and the second collar piece.

17. The device of claim 16, wherein the fastener comprises a screw, a nut and a bolt, or a snap-hold connection.

18. The device of claim 12, wherein the first collar mechanism comprises:

a first collar piece having a first edge and a second edge opposite the first edge;

a second collar piece having a first edge and a second edge opposite the first edge wherein the first edge of the first collar piece is adjoined to the second edge of the second collar piece;

a first snap hold portion connected to the first collar piece along the second edge; and a second snap hold portion connected to the second collar piece along the second edge wherein the first snap hold portion is designed to lock with the second snap hold portion to crimp the first collar mechanism onto the end of the first cord, hose or cable.

19. The device of claim 12, wherein the collar ties are adjustable in length and tension.

20. A securing device, comprising:

a first collar mechanism configured to crimp around a first end of a cord, hose or cable;

a second collar mechanism configured to crimp around an second end of a cord, hose or cable;

a securing means for securing the first end of the cord, hose or cable to the second end of the cord, hose or cable, the securing means comprising:

a first collar tie connected to the first collar mechanism;

a first tie connector attached to the first collar tie;

a second collar tie connected to the second collar mechanism; and a second tie connector attached to the second collar tie, wherein the first tie connector is configured to be fastened to the second tie connector; and a connector means for connecting the first collar tie to the first collar mechanism, the connector means selected from the group consisting of an adhesive, a distended portion wedged within a tapered groove in first collar mechanism, and a single molded unit comprising the first collar tie with the first collar mechanism.

21. A method of securing a connection between a first cord, hose or cable and a second cord, hose or cable comprising:

crimping a first collar mechanism around an end of a first cord, hose or cable wherein the first collar mechanism is connected to a first collar tie and the first collar tie is attached to a first tie connector;

crimping a second collar mechanism around an end of a second cord, hose or cable wherein the second collar mechanism is connected to a second collar tie and the second collar tie is attached to a second tie connector; and fastening the first tie connector with the second tie connector to secure the first cord, hose or cable to the second cord, hose or cable.

* * * * *